US006598607B2

(12) United States Patent
Adiga et al.

(10) Patent No.: US 6,598,607 B2
(45) Date of Patent: Jul. 29, 2003

(54) NON-COMBUSTIBLE SMOKING DEVICE AND FUEL ELEMENT

(75) Inventors: Kayyani C. Adiga, Macon, GA (US); Michael E. Abhulimen, Macon, GA (US); Brian E. Tucker, Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/012,238

(22) Filed: Oct. 24, 2001

(65) Prior Publication Data

US 2003/0075188 A1 Apr. 24, 2003

(51) Int. Cl.[7] ..... A24F 13/12; A24D 1/00

(52) U.S. Cl. ..... 131/194; 131/198.1; 131/361

(58) Field of Search ..... 131/330, 335, 131/361, 194, 195, 198.1; 431/298, 300, 326–329, 320, 321, 325; 432/120, 159; 436/175

(56) References Cited

U.S. PATENT DOCUMENTS

| | | | | |
|---|---|---|---|---|
| 2,549,726 A | | 5/1951 | Toll | |
| 2,549,727 A | | 5/1951 | Toll | |
| 3,674,036 A | * | 7/1972 | Vega | 131/351 |
| 3,698,400 A | | 10/1972 | Tucker | |
| 4,066,088 A | | 1/1978 | Ensor | |
| 4,216,786 A | | 8/1980 | Wright | |
| 4,223,687 A | | 9/1980 | Sandeen | |
| 4,276,892 A | | 7/1981 | Iaquinta | |
| 4,549,523 A | * | 10/1985 | Hirauchi et al. | 126/97 |
| 4,774,970 A | | 10/1988 | Bell | |
| 4,922,901 A | | 5/1990 | Brooks et al. | |
| 4,941,818 A | * | 7/1990 | Ohe et al. | 431/268 |
| 4,947,874 A | | 8/1990 | Brooks et al. | |
| 4,991,606 A | | 2/1991 | Serrano et al. | |
| 5,019,122 A | | 5/1991 | Clearman et al. | |
| 5,040,552 A | | 8/1991 | Schleich et al. | |
| 5,050,621 A | | 9/1991 | Creighton et al. | |

(List continued on next page.)

FOREIGN PATENT DOCUMENTS

| | | | | |
|---|---|---|---|---|
| EP | 307118 A1 | * | 3/1989 | A24F/47/00 |
| FR | 1537026 | | 8/1968 | |
| GB | 1083761 | | 9/1967 | |

*Primary Examiner*—Steven P. Griffin
*Assistant Examiner*—Carlos Lopez
(74) *Attorney, Agent, or Firm*—Charles G. Lamb; John F. Salazer; Middleton Reutlinger

(57) ABSTRACT

A non-combustible smoking article is provided in which a flavor generating medium, such as a commercially available cigarette, is heated with a fuel element including a liquid fuel therein to generate flavors or other components in vapor or aerosol form. A reusable fuel element is inserted in one end of a tubular member and a flavor generating medium, such as a cigarette, is positioned in the opposite end of the tubular member. Spacing between the fuel element and the cigarette is sufficient so that the cigarette is not lit but hot gases come into contact with tobacco or the like in the cigarette to vaporize the flavor components therein.

19 Claims, 1 Drawing Sheet

U.S. PATENT DOCUMENTS

| | | | | |
|---|---|---|---|---|
| 5,060,671 | A | | 10/1991 | Counts et al. |
| 5,065,776 | A | | 11/1991 | Lawson et al. |
| 5,076,292 | A | | 12/1991 | Sensabaugh, Jr. et al. |
| 5,115,820 | A | | 5/1992 | Hauser et al. |
| 5,135,009 | A | | 8/1992 | Muller et al. |
| 5,144,962 | A | | 9/1992 | Counts et al. |
| 5,159,940 | A | | 11/1992 | Hayward et al. |
| 5,190,060 | A | | 3/1993 | Gerding et al. |
| 5,203,355 | A | | 4/1993 | Clearman et al. |
| 5,211,684 | A | | 5/1993 | Shannon et al. |
| 5,240,012 | A | | 8/1993 | Ehrman et al. |
| 5,247,947 | A | | 9/1993 | Clearman et al. |
| 5,345,951 | A | | 9/1994 | Serrano et al. |
| 5,357,984 | A | | 10/1994 | Farrier et al. |
| 5,538,020 | A | | 7/1996 | Farrier et al. |
| 5,588,446 | A | | 12/1996 | Clearman |
| 5,595,577 | A | | 1/1997 | Bensalem et al. |
| 5,730,158 | A | | 3/1998 | Collins et al. |
| 5,944,025 | A | * | 8/1999 | Cook et al. ..... 131/334 |
| 6,196,832 | B1 | * | 3/2001 | Mifune et al. ..... 431/129 |
| 6,217,315 | B1 | * | 4/2001 | Mifune et al. ..... 431/321 |
| 6,446,426 | B1 | * | 9/2002 | Sweeney et al. ..... 60/39.81 |

* cited by examiner

NON-COMBUSTIBLE SMOKING DEVICE AND FUEL ELEMENT

BACKGROUND OF THE INVENTION

The present invention relates to smoking articles, such as cigarettes having a fuel element physically separate from an aerosol-generating material and more particularly for a fuel element for a smoking article.

Cigarettes, cigars and pipes are popular smoking articles which use tobacco in various forms as the medium which upon being ignited provides an aerosol vapor flavorable material to the consumer. In recent years, it has become desirable to provide a smoking article wherein the aerosol-generating material, including tobacco, is heated to a temperature sufficient to vaporize the aerosol-generating flavors in the tobacco and pipe materials, but the temperature is not sufficient for combustion.

Many of the smoking article devices suggested in the art are adapted to look like conventional smoking articles, such as cigarettes while other devices have been developed as an alternative to conventional smoking articles. These articles generally attempt to simulate conventional cigarettes without the combustion of tobacco products. For example, many devices include an internal aerosol forming material that is heated by an internal heating element. The heating stimulates the production of a flavorable aerosol for delivery to a user of the device. The internal heating element has conventionally been either a carbonaceous fuel element or an electrical chemical heat source, such as combinations of metal oxide, and hydrous metal sulphide, metal sulphate and organic salt and a sugar which generate heat on contact with water. In these devices, the cigarette is not capable of being reused. Once the carbonaceous fuel element is lit, it continues to burn unattended until all the fuel in the element is consumed. The lit fuel element is very difficult to extinguish, either with water or other means for extinguishment. In an electro-chemical reaction, the difficulty is countered in stopping the reaction which only terminates when all of the reactants are consumed. Further devices include an electrical l heating element for stimulating an aerosol forming substance. Although these are capable of being turned off between puffs, the electrical heating element requires a battery which requires extra efforts by the consumer and also is generally quite cumbersome. Some of the earlier patents relating to aerosol-generating smoking articles are to be found in United Kingdom patent specification numbers, 1,033,674 and 1,083,761 (Battelle Memorial Institute). Other patents which teach smoking articles capable of providing the pleasure associated with cigarette smoking by heating, but not necessarily burning tobacco, or other similar type materials, and without delivering considerable quantities of uncomplete combustion products, include for example, U.S. Pat. No. 5,065,776 to Lawson et al which teaches a fuel element positioned in heat exchange relationship with a physically separate aerosol-generating means and U.S. Pat. No. 5,144,962 which teaches a non-combustion smoking article which includes a hollow tube with tobacco therein and the heat vaporizing the aerosols in the tobacco is a temperature co-efficient thermistor in thermal contact with the tobacco wherein the thermistor is heated with an electrical current. Thus, it is desirable to provide an article that closely simulates a conventional cigarette but does not require the combustion of tobacco and can be reused.

SUMMARY OF THE INVENTION

It is an object of the present invention to provide a fuel element for a smoking article as a heat source to vaporize flavoring compounds of a smoking article.

It is another object of the present invention to provide a fuel element for a smoking article which is reusable.

It is a further object of this invention to provide a smoking article which can have the appearance of a conventional cigarette.

It is an even further object of the present invention to provide a smoking article which includes a reusable fuel element in a conventional cigarette.

More particularly, the present invention provides a fuel element for a smoking article and a smoking article including the fuel element. The fuel element includes a fuel tank with a fuel cartridge therein which is generally porous with a liquid fuel therein. A wick is in flow communication with the fuel cartridge and a glow filament is disposed adjacent to the wick and glows in response to the burning of fuel in the wick. The smoking article includes a hollow tube with a flavor generating material disposed within the tube, such as a commercially available cigarette, and a fuel element is disposed in the tube and adjacent the flavor generating material.

BRIEF DESCRIPTION OF THE DRAWINGS

A better understanding of the invention will be had upon reference to the following detailed description in conjunction with the accompanying drawings in which like numerals refer to like parts throughout the several views and wherein:.

DETAILED DESCRIPTION OF THE PREFERRED EMBODIMENT

Figure 1:
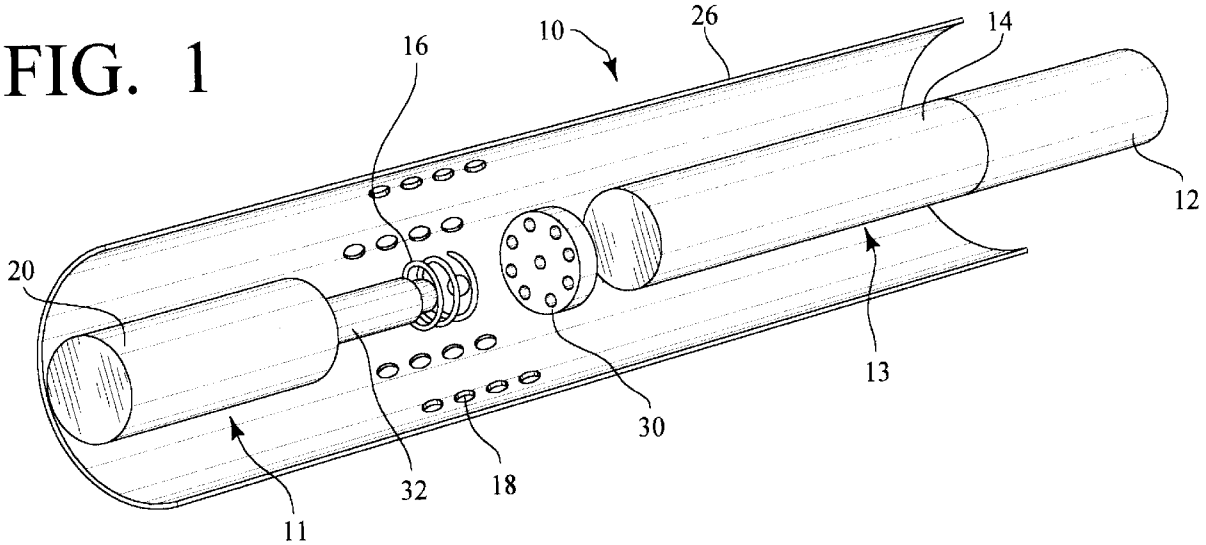
FIG. 1 is a partially fragmentary perspective view of one embodiment of a non-burning smoking article of the present invention; and, FIG. 2 is a longitudinal sectional view of the non-burning smoking article of FIG. 1.
Figure 2:
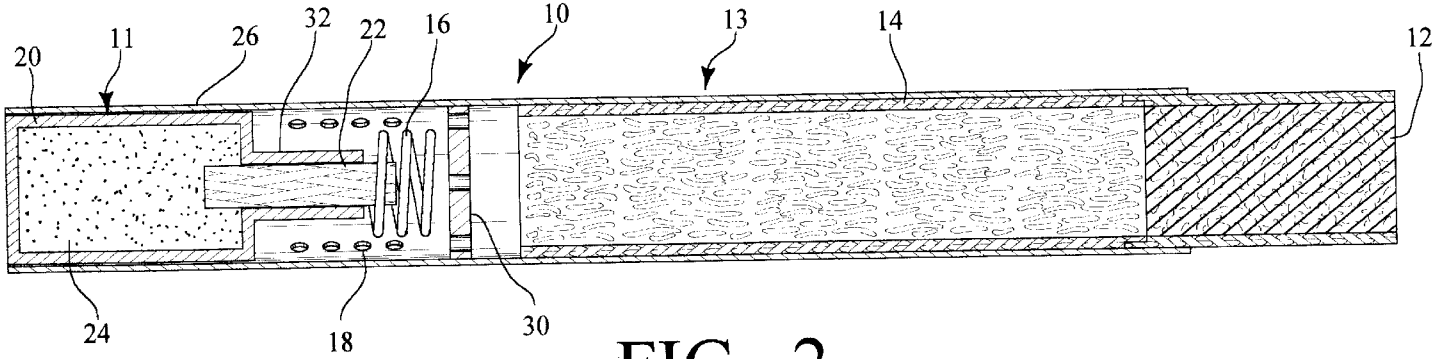

As shown in the Figs., a non-burning smoking article 10 includes a fuel element, designated by the numeral 11, and a flavor-generating material, such as a conventional cigarette generally identified by the numeral 13 disposed within a tubular wrapper 26. The conventional cigarette 13 generally includes a tobacco rod 14 attached to a filter 12.

The fuel element 11 includes a fuel tank 20 filled with a porous fuel cartridge 24, including usually a carbonaceous liquid fuel, such as ethanol or other low molecular weight hydrocarbon oils which saturates porous fuel cartridge 24, an extended wick 22 and a glow element or filament 16. The fuel element 11 is encased in one end of the tubular wrapper 26 which is provided with a plurality of puffing air inlets 18 which is slightly upstream of the glow element 16 so that during use puffing air is brought in through the inlets 18 and provide oxygen for the burning of the fuel in the wick 22. The fuel tank 20 is provided with an open end which receives a ceramic tube 32, or the like, which surrounds the wick 22. The glow element 16 is generally a coil made out of copper wire or other heat conducting or glowing materials such as brass, platinum, or a metallic alloy which is inserted at the open end of the ceramic tube 32. Wick 22, which is usually non-burning fibers or glass capillary tubes, extends generally a short distance, such as 1–2 mm, into the glow element or filament 16. The glow element may include a chamber with a catalyst material, such as copper, brass, platinum coated ceramic, or a coated ceramic based material, formed of beads or fibrous particles. In use, the filament 16 is lit using a commercially available lighter, such as a butane type lighter.

The fuel cartridge 24 is generally a porous media, such as, cellulose acetate, low density polyethylene, ethyl vinyl acetate, carbon filters, cotton, or other fabric materials.

The tubular wrapper 26 is non-combustible on the application of a flame or at least not easily ignited. Suitable materials for the tubular wrapper 26 are ceramic, meerschaum, metal, paper, paperboard, reconstituted tobacco, wood, bamboo, glass, metal foil, and combinations thereof. Any of the foregoing materials may be treated to prevent combustion. Chemical treatments for reducing a propensity for combustion are well known in the art.

Also disposed within the tubular wrapper 26 is a heat diffuser 30 which is positioned within the tubular wrapper 26 between the distal end of the flavor generation material 13 and the heating element 7. The heat diffuser 30 serves to deliver the hot gasses and hot air coming in during the tubular member 26 through the puffing air inlets 18 to the vapor generating material (cigarette) 13 through holes contained within the diffuser 30. Additionally, the heat diffuser 30 blocks the flame from contact with the cigarette 13 upon the application of suction at the filter end or mouth end of the cigarette by the user. This facilitates preventing ignition and substantial burning of the cigarette 13. The heat diffuser 30 may also be treated with a catalyst for converting carbon monoxide into carbon dioxide or another catalyst for converting or eliminating other selected hydrocarbons produced by various types of flames and heating elements. The heat diffuser 30 may be of any type of appropriate material which meets the needs, but is preferably in wire mesh form.

In operation, smoking article 10 is started by lighting the end of the glow element 16 as in conventional cigarettes. The fuel is then drawn into the filament 16 by the non-burning wick 22. The fuel vaporizes and reacts on the metal filament which then glows continuously. During the puff by the consumer, air is pulled through the air inlets 18, across the filament 16, causing combustion of the vaporized fuel. Between puffs, the filament 16 maintains its glow. When ready to extinguish the smoking article, the fuel supply is cut off by sliding a cap or the like, such as a ceramic tube, over the exposed end of the wick.

The foregoing detailed description is giving primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A smoking article comprising:

a hollow tube;

a flavor generating material disposed within a mouth end of said tube;

a fuel element disposed within a distal end of said hollow tube and spaced from said flavor generating material, said fuel element including a fuel tank having an opening in one end;

a fuel cartridge disposed within said fuel tank, said fuel cartridge including liquid fuel;

a wick in flow communication with said cartridge, and, a glow filament adjacent to said wick and operative in response to burning of fuel from said wick.

2. The smoking article of claim 1 wherein said flavor generating material is a cigarette.

3. The smoking article of claim 1 including puffing air inlets in said hollow tube upstream of said fuel element.

4. The smoking article of claim 1 wherein said flavor generating material is tobacco.

5. The smoking article of claim 1 including a heat diffuser between said fuel element and said flavor generating material.

6. The smoking article of claim 5 wherein said heat diffuser is a wire mesh screen.

7. The smoking article of claim 1 wherein said hollow tube is ceramic.

8. The smoking article of claim 1 wherein said liquid fuel is ethanol or a low molecular weight hydrocarbon oil.

9. The smoking article of claim 1, said liquid fuel being selected from the group consisting of ethanol and low molecular weight hydrocarbon oils.

10. The smoking article of claim 1, said glow filament being copper, brass, platinum or a metallic alloy.

11. The smoking article of claim 1, said fuel cartridge includes a porous media.

12. The smoking article of claim 11, said porous media being cellulose acetate, low density polyethylene, ethyl vinyl acetate, carbon filters, cotton, or other fabric materials.

13. The smoking article of claim 1, said wick being non-burning fibers or glass capillary tubes.

14. The smoking article of claim 1, including air inlet holes upstream of said glow filament.

15. The smoking article of claim 1, said glow filament comprising a chamber with catalyst material formed of beads or fibrous particles.

16. The smoking article of claim 15, said catalyst being copper, brass, platinum coated ceramic or a coated ceramic based material.

17. The smoking article of claim 12, said wick and said porous media being the same material.

18. The smoking article of claim 1, including a tube surrounding said wick.

19. The smoking article of claim 18, said tube surrounding said wick being a ceramic.

* * * * *